US007341679B2

(12) United States Patent
Handa

(10) Patent No.: US 7,341,679 B2
(45) Date of Patent: Mar. 11, 2008

(54) ORGANIC POSITIVE TEMPERATURE COEFFICIENT THERMISTOR AND MANUFACTURING METHOD THEREFOR

(75) Inventor: Tokuhiko Handa, Ichikawa (JP)

(73) Assignee: TDK Corporation, Tokyo (JP)

( * ) Notice: Subject to any disclaimer, the term of this patent is extended or adjusted under 35 U.S.C. 154(b) by 511 days.

(21) Appl. No.: 10/873,105

(22) Filed: Jun. 23, 2004

(65) Prior Publication Data

US 2005/0024180 A1 Feb. 3, 2005

(30) Foreign Application Priority Data

Jun. 24, 2003 (JP) ..... 2003-180074

(51) Int. Cl.
*H01B 1/00* (2006.01)
*H01B 1/12* (2006.01)
*H01C 7/02* (2006.01)

(52) U.S. Cl. ..... 252/500; 338/22 R; 338/224; 338/275; 252/502; 252/503; 252/512; 219/505

(58) Field of Classification Search ..... 252/519.12, 252/500, 502, 503, 512; 338/22 R, 224, 338/275; 264/616; 428/376; 219/505
See application file for complete search history.

(56) References Cited

U.S. PATENT DOCUMENTS

| | | | | |
|---|---|---|---|---|
| 2,981,699 | A * | 4/1961 | Ichikawa | 252/519.12 |
| 3,243,758 | A | 3/1966 | Frant et al. | |
| 3,351,882 | A | 11/1967 | Kohler et al. | |
| 3,916,071 | A * | 10/1975 | Kinnebrew et al. | 428/376 |
| 4,315,237 | A * | 2/1982 | Middleman et al. | 338/22 R |
| 4,752,762 | A * | 6/1988 | Inano et al. | 338/22 R |
| 4,981,633 | A * | 1/1991 | Alles et al. | 264/616 |
| 5,077,889 | A * | 1/1992 | Matsuda et al. | 29/612 |
| 5,815,063 | A * | 9/1998 | Goto et al. | 338/22 R |
| 5,945,034 | A | 8/1999 | Handa et al. | |
| 6,218,928 | B1 * | 4/2001 | Okada et al. | 338/22 R |
| 6,346,496 | B2 * | 2/2002 | Nabika et al. | 501/137 |
| 6,558,579 | B2 | 5/2003 | Handa et al. | |
| 6,607,679 | B2 | 8/2003 | Handa et al. | |
| 2003/0218530 | A1 | 11/2003 | Yoshinari et al. | |
| 2006/0132280 | A1 * | 6/2006 | Kirsten | 338/22 R |

FOREIGN PATENT DOCUMENTS

| | | |
|---|---|---|
| JP | 02-248002 | * 10/1900 |
| JP | 64-002301 | * 1/1989 |
| JP | 01-146301 | * 6/1989 |
| JP | 05-304003 | * 11/1993 |
| JP | A 2002-190401 | 7/2002 |
| JP | A 2003-133103 | 5/2003 |

* cited by examiner

*Primary Examiner*—Lorna M. Douyon
*Assistant Examiner*—Khanh Tuan Nguyen
(74) *Attorney, Agent, or Firm*—Oliff & Berridge, PLC

(57) ABSTRACT

An organic positive temperature coefficient thermistor 10 having at least a pair of electrodes 2 and 3 positioned facing each other and a thermistor element 1 having a positive temperature coefficient of resistance which is positioned between the pair of electrodes 2 and 3, wherein the thermistor element 1 is a molded element consisting of a mixture which contains a polymer matrix and conductive particles having electronic conductivity, and wherein the thermistor element 1 has an amount of oxygen calculated by subtracting the amount of oxygen originally present in the various components of the mixture from the amount of oxygen contained in the thermistor element, which is 1.55 weight percent or less of the mass of the thermistor element.

7 Claims, 2 Drawing Sheets

ORGANIC POSITIVE TEMPERATURE COEFFICIENT THERMISTOR AND MANUFACTURING METHOD THEREFOR

BACKGROUND OF THE INVENTION

1. Field of the Invention

The present invention relates to an organic positive temperature coefficient thermistor and a manufacturing method therefor.

2. Related Background Art

A positive temperature coefficient (PTC) thermistor has a composition which comprises at minimum a pair of electrodes positioned facing each other and a thermistor element positioned between this pair of electrodes. Moreover, this thermistor element has a "positive temperature coefficient of resistance," meaning that within a specific temperature range, its resistance rises sharply as the temperature rises.

Taking advantage of these features, positive temperature coefficient thermistors (hereunder "PTC thermistors") are used for example as self-regulating heat generators, temperature sensors, current limiting elements, over-current protection elements and the like. For purposes of use as an over-current protection element in particular, a PTC thermistor needs to have low room-temperature resistance when not in operation, a large rate of change from room temperature resistance when not in operation to resistance when in operation, a small change in resistance when operated repeatedly (difference between resistance upon initial use and resistance after repeated operation), excellent breaking characteristics and a low heating temperature of the element, and it must be capable of being made small, light-weight and at low cost.

Conventional PTC thermistors have generally been of the type equipped with a thermistor element made of ceramic material, but this type of PTC thermistor has high room-temperature resistance and a high heating temperature of the thermistor element, and has been difficult to make small, light-weight and at low cost.

Therefore, in order to meet the aforementioned demand for lower operating temperature, lower room-temperature resistance and the like, a type of organic positive temperature coefficient thermistor is being studied which comprises a molded element consisting of a polymer matrix and conductive particles as the thermistor element (hereunder, "P-PTC thermistor").

For example, a P-PTC thermistors of this sort has been proposed which is equipped with a thermistor element formed using low-density polyethylene as the polymer matrix and carbon black as the conductive particles (conductive filler) (see for example U.S. Pat. Nos. 3,243,758 and 3,351,882). The operating temperature of this thermistor element can be reduced by selecting an appropriate polymer matrix.

However, although such a P-PTC thermistor using carbon black as the conductive particles has lower room-temperature resistance than the aforementioned thermistor using a thermistor element made of ceramic material, it is becoming clear that its characteristics are still inadequate. Namely, it has been shown that if the conductive filler (carbon black) content is increased in an effort to reduce room-temperature resistance, the difference in resistance (rate of change in resistance) between the non-operating and operating states is reduced, and the thermistor cannot withstand actual use.

Therefore, these inventors and others have proposed P-PTC thermistors using nickel powder or other spiky particles as the conductive filler. Since the room-temperature resistance of such a P-PTC thermistor can be made sufficiently low, and the rate of change in resistance is high, the aforementioned problems of conventional PTC thermistors can be resolved. Moreover, it has been shown that it is also possible to reduce the operating temperature by appropriate selection of the matrix material as necessary, and that addition of a low molecular weight organic compound is effective as a method therefor.

SUMMARY OF THE INVENTION

However, after a close study of conventional P-PTC thermistors, the inventors discovered that such conventional P-PTC thermistors lack stability of resistance. That is, it was found that when such a P-PTC thermistor is operated and then returned to a non-operating state, its resistance is different from the resistance before operation (in most cases, higher than the resistance before operation), and that its resistance becomes unstable if it is stored for example for a long period of time.

Thus, with the foregoing in view it is an object of the present invention to provide a P-PTC thermistor with excellent stability of resistance.

After exhaustive research aimed at achieving the aforementioned object by focusing on the components of the thermistor element of a P-PTC thermistor, the inventors discovered that the aforementioned object could be achieved when the amount of a specific component contained in the thermistor element could be kept at or below a certain level.

Namely, the P-PTC thermistor of the present invention comprises a pair of electrodes positioned facing each other and a thermistor element positioned between the pair of electrodes and having a positive temperature coefficient of resistance, wherein the thermistor element is a molded element consisting of a mixture which contains a polymer matrix and conductive particles having electronic conductivity, and wherein the thermistor element has an amount of oxygen, which is 1.55 weight percent or less of the thermistor element, calculated by subtracting the amount of oxygen originally present in the various components of the mixture from the amount of oxygen contained in the thermistor element.

The reason why this P-PTC thermistor element has excellent stability of resistance is still not entirely clear, but is believed by the inventors to be as follows.

First, the operating principles of the P-PTC thermistor are believed to be as follows. That is, at low temperatures a conductive path exists due to linkage of the conductive particles contained in the thermistor element. Current flows through the P-PTC thermistor via this conductive path. However, if the P-PTC thermistor is subjected to excess heat or current the temperature thereof rises, and the polymer matrix contained in the thermistor element expands, resulting in breakage of the conductive path (linkage of conductive particles). It is thought that since current then ceases to flow along the conductive path, excess current is controlled, and the danger of current flowing during overheating is avoided. As the temperature of the P-PTC thermistor subsequently drops, it is thought that the polymer matrix which had expanded then shrinks again, so that the conductive particles become linked again to form a conductive path along which the current then flows.

Next, the reason for the low stability of resistance of a conventional P-PTC thermistor is considered. It is thought that the polymer matrix contained in the thermistor element of a conventional P-PTC is unable for some reason to shrink adequately following a rise and then fall in temperature, so that the conductive particles do not link again to fully re-create the conductive path, and the resistance of the P-PTC thermistor cannot return to its initial condition. Another possibility is that when there is a rise and fall in temperature or when the P-PTC thermistor is stored for a long period of time, the surface resistance of the conductive particles contained in the thermistor element of the P-PTC thermistor rises so that the resistance of the P-PTC thermistor cannot return to the initial condition.

Next, the reason why the resistance of the P-PTC thermistor of the present invention is stable even following operation with a rise and fall in temperature is considered. Considering a case in which the thermistor element is contaminated with oxygen, the oxygen contaminating the thermistor element (hereunder, oxygen contamination) at first exists in the thermistor element without binding to the polymer matrix. However, it is thought that repeated operation with rising and falling temperatures or long-term storage of the P-PTC thermistor results in gradual oxidation of the polymer matrix due to the oxygen contamination. As the polymer matrix oxidizes, the crystallinity of the polymer matrix tends to fall or else the molecular weight tends to drop. When the characteristics of the polymer matrix change in this way the polymer matrix takes more time to crystallize when the temperature falls, and does not shrink adequately. As a result, re-creation of the conductive path through linkage of the conductive particles does not occur, and the initial resistance cannot be achieved.

A reason such as the following is also possible. That is, oxygen contaminating the thermistor element oxidizes the surface of the conductive particles. It is possible that the surface conductivity of the conductive particles is thus reduced, so that when returned to non-operating condition, or in other words when the temperature falls, the shrinkage condition of the polymer matrix is slightly different from the initial condition, and the resistance cannot return to a value equivalent to the initial value. In other words, the resistance cannot return to a value equivalent to the initial value by only slight difference of the shrinkage condition of the polymer matrix from the initial condition.

However, the stability of resistance of the P-PTC thermistor of the present invention is sufficiently high because oxygen other than oxygen originally present in the various components of the thermistor element, or in other words oxygen which contaminates the thermistor element during the P-PTC thermistor manufacturing process, is limited to 1.55 weight percent or less of the mass of the thermistor element.

Moreover, in the P-PTC thermistor of the present invention the conductive particles are preferably metal particles. Because metal particles are good conductors, the room-temperature resistance is low during non-operation.

Moreover, the conductive particles are preferably particles made of nickel and are preferably filamentous particles. When such particles are distributed uniformly in a polymer matrix, the reliability of the P-PTC thermistor with respect to repeated operation and long-term storage (hereunder, simply "reliability") tends to be higher.

Moreover, it is preferable in the P-PTC thermistor of the present invention that the thermistor is element also contain a low molecular weight organic compound. In this way the hysteresis which appears in the resistance/temperature characteristics curve of the P-PTC thermistor can be minimized, the rate of change in resistance is increased, and the operating temperature can also be regulated.

In the method for manufacturing the P-PTC thermistor of the present invention, the P-PTC thermistor is manufactured with the oxygen removed from the atmosphere to which the components of the thermistor element are exposed in order to obtain the aforementioned P-PTC thermistor. In this way it is possible to obtain the desired P-PTC thermistor because oxygen contamination of the thermistor element can be adequately controlled.

In the method for measuring oxygen content of the present invention, a sample containing an organic compound is impulse heated and melted and the oxygen contained in the sample is converted to carbon monoxide or carbon dioxide gas, after which the carbon monoxide or carbon dioxide gas is analyzed by infrared absorption spectrometry in order to measure the oxygen content of the aforementioned sample. In this way it is possible to measure not only the oxygen originally present in the chemical structure of the organic compound, but also oxygen which has contaminated the structure of the organic compound. Moreover, it is also possible to measure the total content of oxygen contained in a mixture of an inorganic compound and an organic compound. Consequently the oxygen content of the thermistor element provided in the P-PTC thermistor of the present invention can also be measured. In addition, the oxygen from the atmosphere, to which the components of the thermistor element are exposed, can be removed while the results of the measurements are consulted. In this way, the P-PTC thermistor of the present invention can be obtained efficiently.

DESCRIPTION OF THE PREFERRED EMBODIMENTS

Preferred embodiments of the P-PTC thermistor of the present invention are explained in detail below with reference to figures.

Figure 1:
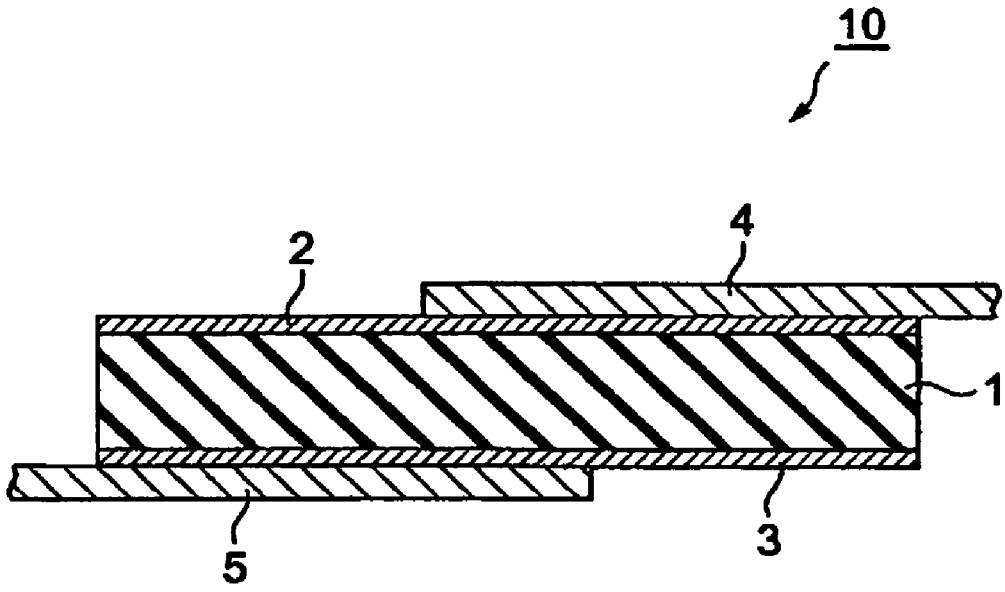
FIG. 1 is a typical cross-sectional diagram showing the basic configuration of one embodiment of the P-PTC thermistor of the present invention.

FIG. 1 is a typical cross-section showing the basic composition of an embodiment of the P-PTC thermistor of the present invention.

The P-PTC thermistor 10 shown in FIG. 1 consists of a pair of electrodes, an electrode 2 and an electrode 3, which are positioned facing each other, a thermistor element 1 which is positioned between the electrode 2 and the electrode 3 and has a positive temperature coefficient of resistance, a lead 4, which is connected electrically to the electrode 2 as necessary, and a lead 5, which is connected electrically to the electrode 3.

The electrode 2 and the electrode 3 have a plate shape for example, and are not particularly limited as long as they have the electronic conductivity to function as electrodes of a P-PTC thermistor. There are also no particular limitations on the lead 4 and the lead 5 as long as they have the electronic conductivity to emit or inject electrical charge externally from the electrode 2 and the electrode 3, respectively.

The thermistor element 1 of the P-PTC thermistor 10 in FIG. 1 is a molded element consisting of a mixture containing a polymer matrix and conductive particles having electronic conductivity (hereunder called simply "conductive particles"). In addition, this thermistor element 1 has the following composition so as to give the P-PTC thermistor 10 sufficiently high stability of resistance.

In the thermistor element 1, the amount of oxygen calculated by subtracting the oxygen originally present in the various components of the mixture from the amount of oxygen contained in the thermistor element 1 is 1.55 weight percent or less of the mass of the thermistor element 1.

In these specifications the "oxygen contained in the thermistor element" signifies all oxygen contained in the thermistor element, which is divided into the oxygen originally present in the Various components of the thermistor element and other oxygen contained in the thermistor element.

The "oxygen originally present in the various components of the thermistor element" signifies the oxygen present in the chemical structures of the polymer matrix, the conductive particles and other components of the thermistor element. Consequently, if for example straight chain, low density polyethylene is used as the polymer matrix, the oxygen originally present in this polymer matrix is none. If polymethyl methacrylate is used as the polymer matrix, the oxygen originally present in this polymer matrix is the oxygen of the ester bonds (two per ester bond) in the polymethyl methacrylate molecule.

"Other oxygen contained in the thermistor element" signifies for example oxygen which contaminates the components of the thermistor element by adsorption, absorption or the like when such components of the thermistor element are stored before the P-PTC thermistor is manufactured. Another example is oxygen in the atmosphere to which the thermistor element or components thereof are exposed in the P-PTC thermistor manufacturing process, or oxygen present in equipment, liquids and the like with which they come into contact, which contaminates the thermistor element or the like by adsorption, absorption or the like. When metal particles are used as the conductive particles, oxygen which forms a surface oxide film (passive film) on the metal particles is included as "other oxygen contained in the thermistor element." The state of this oxygen may be an atomic, molecular or ionic state.

Consequently, the "amount of oxygen calculated by subtracting the oxygen originally present in the various components of the mixture from the oxygen content of the thermistor element" is the aforementioned "other oxygen contained in the thermistor element."

If this amount of oxygen is 1.55 weight percent or less of the mass of the thermistor element 1, the P-PTC thermistor 10 equipped with this thermistor element 1 can have sufficiently high stability of resistance.

From the standpoint of lowering the resistance upon initial use and ensuring excellent stability of resistance, this amount of oxygen should preferably be 1.50 weight percent or less or more preferably 0.50 weight percent or less or still more preferably 0.34 weight percent or less.

This amount of oxygen and the amounts of oxygen originally present in the various components of the thermistor element can be calculated by the following method.

First, a solid sample or the like containing an organic compound, such as the thermistor element used in the present invention, is melted by heating the sample to about 2000° C. in an impulse furnace with flowing helium gas, argon gas or other inactive gas. In this specification, this heating and melting is called "impulse heating and melting." The oxygen contained in the aforementioned sample is thus converted to carbon monoxide or carbon dioxide, and is isolated and extracted as carbon monoxide/carbon dioxide gas from the heated and melted product. This carbon monoxide/carbon dioxide gas is supplied to an infrared absorption spectrometer by the aforementioned inactive gas. By using the infrared absorption spectrometer to analyze the carbon monoxide/carbon dioxide gas, it is possible to measure the amount of carbon monoxide/carbon dioxide. The amount of oxygen contained in the sample is then derived by conversion from this amount of carbon monoxide/carbon dioxide gas.

When it is clear that the components contained in the thermistor element do not have any of the aforementioned "oxygen originally present in the various components of the thermistor element" (for example, polyethylene is used as the polymer matrix), only the amount of oxygen contained in the thermistor element is measured, and the resulting amount of oxygen can be taken as the "amount of oxygen calculated by subtracting the oxygen originally present in the various components of the mixture from the oxygen content of the thermistor element."

When the components contained in the thermistor element have "oxygen originally present in the various components of the thermistor element," the amounts of oxygen originally present in these various components are measured by the aforementioned measurement method, and the total is given as the amount of "oxygen originally present in the various components of the thermistor element."

The amount of oxygen in the structure of an organic elemental substance can be calculated by specifying the structure using spectroscopic methods (infrared absorption, nuclear magnetic resonance or the like) or mass spectrometry. An elementary analysis device can also be used. In addition to the aforementioned impulse heating and melting measurement method (hereunder, "impulse heating and melting measurement"), the amount of oxygen in an inorganic conductive filler or inorganic non-conductive filler added as an additive which contains oxygen in its structure can also be calculated by specifying the structure by X-ray analysis or the like. The amount of oxygen in the structure of the aforementioned organic elemental substance is preferably measured from the starting raw material, but it is also possible to isolate the various components by various extraction and isolation methods from the manufactured thermistor element or the like, and measure the amount of oxygen in their structures.

Next, the "amount of oxygen contained in the thermistor element" is measured by the aforementioned impulse heating and melting measurement method for a thermistor-element prepared using these components, and the value derived by subtracting the aforementioned "amount of oxygen originally present in the various components of the thermistor element" from this amount of oxygen is given as the "amount of oxygen calculated by subtracting the original oxygen content of the various components of the mixture from the oxygen content of the thermistor element."

Examples of devices for measuring the oxygen content of a sample or the like containing an organic compound in this way include the LECO Corporation TC-600 (trade name) and the like.

The polymer matrix contained in the thermistor element 1 may be either a thermoplastic resin or a thermosetting resin, and may be either a crystalline resin or a non-crystalline resin. "Crystalline resin" here signifies a resin whose melting point can be observed by ordinary thermal analysis, while a "non-crystalline resin" signifies a resin whose melting point cannot be observed by ordinary thermal analysis.

For example, an olefin polymer, halogen polymer, polystyrene, epoxy resin, unsaturated polyester resin, diallylphthalate resin, phenol resin, thermosetting polyimide resin, melamine resin or the like can be used as the polymer matrix. Examples of olefin polymers include polyethylene, ethylene-vinyl acetate copolymer, polyethyl acrylate and other polyalkyl acrylates, polymethyl acrylate and other polyalkyl acrylates, polymethyl methacrylate and other polyalkyl methacrylates and other olefins or copolymers thereof. Examples of halogen polymers include fluorine polymers such as polyvinylidene fluoride, polytetrafluoroethylene, polyhexafluoropropylene or copolymers thereof, and chlorine polymers such as polyvinyl chloride, polyvinylidene chloride, chlorinated polyvinyl chloride, chlorinated polyethylene or chlorinated polypropylene or copolymers thereof and the like one of these may be used alone or two or more may be used in combination.

Of these it is desirable to use an olefin polymer, and more desirable to use polyethylene, and it is particular desirable to use straight chain, low density polyethylene manufactured using a metallocene catalyst.

Straight chain, low density polyethylene manufactured by a polymerization reaction using a metallocene catalyst offers the feature of a narrower molecular weight-distribution than that manufactured using a conventional Zeigler-Natta catalyst. The "metallocene catalyst" here is a bis (cyclopentadienyl) metallic complex, a compound which is expressed by the following general formula (1):

$$M(C_5H_5)_2XY \quad (1)$$

In formula 1 above, M represents a metal or metal ion which is the center of 4 coordination, and X and Y represent halogens or halide ions which may be the same or different. Ti, Zr, Hf, V, Nb or Ta are desirable as M, with Zr being most desirable. Cl is desirable for X and Y. One kind of compound represented by general formula 1 may be used alone, or any combination of two or more can be used.

Straight chain, low density polyethylene can be manufactured by well-known techniques of low density polyethylene manufacture, using the metallocene catalyst of formula 1 above. In addition to ethylene as the raw material monomer, butene-1, hexene-1 and octene-1 can be used as co-monomers.

The compounds represented by general formula 2 and general formula 3 below can also be used together with the metallocene catalyst.

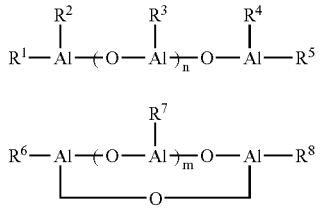

(2)

(3)

In formula 2 above, $R^1$, $R^2$, $R^3$, $R^4$ and $R^5$ represent alkyl groups with 1 to 3 carbon atoms each which may be the same or different, and n represents an integer between 2 and 20. Methyl groups are preferred for $R^1$, $R^2$, $R^3$, $R^4$ and $R^5$. In formula 3 above $R^6$, $R^7$ and $R^8$ represent alkyl groups with 1 to 3 carbon atoms which may be the same or different, and m represents an integer between 2 and 20. Methyl groups are preferred for $R^6$, $R^7$ and $R^8$.

The type, the average molecular weight, the melting point, the density and the like of polymer matrix can be selected as necessary in order to keep the operating temperature of the P-PTC thermistor within the desired range. For example, polyethylene with a weight average molecular weight of 50,000 to 500,000 or more preferably 80,000 to 300,000, a melting point of 100 to 140° C., and a density of 0.910 to 0.970 g/cm$^3$ can be used as the polymer matrix.

The "melting start temperature" of the polymer matrix is a temperature defined as follows using a DSC curve obtained by differential scanning calorimetry (DSC) analysis using the polymer matrix as the measurement sample. Namely, it indicates the temperature at the intersection of the baseline and the tangent at the inflection point which appears at the lowest temperature of the first endothermic peak on a DSC curve obtained by raising the temperature of a measurement sample and a standard substance from room temperature (25° C.) at a fixed programming rate (2° C./min.). In the present invention, a powder consisting of $\alpha$-$Al_2O_3$ is used as the standard substance (thermally stable substance) in the aforementioned differential scanning calorimetry.

There are no particular limitations on the conductive particles contained in the thermistor element 1 as long as they have electronic conductivity, and for example carbon black, graphite or metal particles or ceramic conductive particles of various shapes can be used. One kind thereof can be used alone or two or more kinds can be used in combination.

Of these, conductive metal particles are used by preference for applications in which both low room temperature resistance and an adequate rate of change in resistance is required, such as over-current protection elements. Conductive metal particles which can be used include copper, aluminum, nickel, tungsten, molybdenum, silver, zinc, cobalt or the like, with silver or nickel being used by preference. Examples of shapes thereof include spheres, flakes, rods or the like, but those having spiky projections on the surface are preferred. Such conductive metal particles may be in the form of powder in which each particle (primary particle) exists independently, but preferably they should form filamentous secondary particles in which the primary particles are linked in chains. Preferably the material is nickel, the specific surface area is 0.4 to 2.5 m$^2$/g, and the apparent density is about 0.3 to 1.0 g/cm$^3$.

"Specific surface area" here signifies specific surface area as derived by gaseous nitrogen absorption based on the one-point BET method.

When carbon black or ceramic conductive particles are used as the conductive particles, the oxygen in their crystal structures is included in "oxygen originally present in the various components of the thermistor element,"while oxygen which forms a surface oxide film is included in "other oxygen contained in the thermistor element."

The thermistor element 1 can also contain a low molecular weight organic compound. Using this low molecular weight organic compound has the effect of increasing the rate of change of resistance, regulating the operating temperature and reducing hysteresis which appears in the resistance/temperature curve.

Examples of low molecular weight compounds include waxes, fats, oils, crystalline resins and the like. Examples of waxes include petroleum waxes such as paraffin wax, microcrystalline wax and the like, and natural waxes such as plant waxes, animal waxes, mineral waxes and the like. Examples of fats and oils include those normally called fats or solid fats and the like.

Examples of crystalline resins include polyolefin crystalline resins such as polyethylene crystalline resin or polypropylene crystalline resin, and polyester crystalline resin, polyamide crystalline resin, fluorine crystalline resin and the like. One of these can be used alone or two or more can be used in combination. Crystalline resins here include not only those which are wholly crystallized but also those which are partially crystallized. The degree of crystallization is preferably 10 to 80% or more preferably 15 to 70%.

The molecular weight (weight average molecular weight) of this low molecular weight organic compound is preferably 100 to 5000 or more preferably 500 to 2000 in order to regulate the operating temperature of the P-PTC thermistor 10 within a suitable range. The melting point is preferably 60 to 120° C.

The oxygen in the structure of the aforementioned low molecular weight organic compound is included as "oxygen originally present in the various components of the thermistor element." For example, if polyester crystalline resin or polyamide crystalline resin is used as the low molecular weight organic compound, the oxygen in the ester bonds or amide bonds is included as "oxygen originally present in the various components of the thermistor element."

The content of conductive particles in the thermistor element 1 should be 20 to 45% by volume with the volume of the thermistor element 1 as the standard. If the content of conductive particles is less than 20% by volume it is not possible to keep the room temperature resistance sufficiently low during non-operation. If it exceeds 45% by volume, the change in resistance as the temperature increases is less, uniform mixing is difficult and it becomes difficult to obtain a reproducible resistance.

When the thermistor element 1 contains a low molecular weight organic compound, the content of the low molecular weight organic compound is preferably 5 to 50% by volume of the content of the polymer matrix. If the content of the low molecular weight organic compound is less than 5% by volume, it is difficult to obtain an adequate rate of change in resistance. If the content of the low molecular weight organic compound exceeds 50% by volume, the thermistor element 1 is greatly deformed when the low molecular weight organic compound melts, and it is difficult to knead with the conductive particles.

In addition to what is mentioned above, the thermistor element 1 of the P-PTC thermistor 10 may contain various additives which are conventionally added to thermistor elements.

When various additives are used, the oxygen in the chemical structures of the additives is included as the aforementioned "oxygen originally present in the various components of the thermistor element."

In order for the amount of the aforementioned "other oxygen contained in the thermistor element" to be 1.55 weight percent or less of the mass of the thermistor element 1, it is preferable to prevent the components of the thermistor element 1 from being contaminated with oxygen by adsorption, absorption or the like when they are stored in storage containers or the like before being used in the manufacturing process of the P-PTC thermistor 10. Consequently, these components should preferably be stored so as to have no direct contact with oxygen.

There are no particular limits on such storage methods as long as they do not cause damage to the components, and examples include such methods as storage in storage containers with an inactive gas such as argon gas or helium gas substituted, storage in storage containers under vacuum or reduced pressure, storage in storage containers containing an oxygen scavenger, or storage in a petroleum solvent if the material is insoluble in petroleum solvents and the like.

Moreover, in order for the amount of the aforementioned "other oxygen contained in the thermistor element" to be 1.55 weight percent or less of the thermistor element 1, it is desirable that oxygen which has already contaminated the components of the thermistor element 1 be removed before they are used in the manufacturing process of the P-PTC thermistor 10. Any conventionally known method can be used as this oxygen removal method, without any particular limitations. Examples of methods of removing oxygen contaminating a polymer matrix include methods of heating the polymer matrix under reduced pressure or in an environment of flowing inactive gas. When metal particles are used as the conductive particles, oxygen on the surface of the metal particles can be removed by a known chemical treatment method such as with a reducing agent, a known electrical-treatment method such as reduction removal of the oxide film by cathode treatment, or a known physical treatment method such as removal of the oxide film with an abrasive.

Next, the method for manufacturing the P-PTC thermistor 10 is explained. In order for the amount of the aforementioned "other oxygen contained in the thermistor element" to be 1.55 weight percent or less of the mass of the thermistor element 1, it is desirable that the various components of the thermistor element 1 also not be brought into contact with oxygen in the manufacturing process of the P-PTC thermistor 10.

First, the polymer matrix and conductive particles together with a low molecular weight organic compound or additives as necessary are mixed and kneaded (mixing and kneading step). The device used in this mixing and kneading step may be for example a thermal kneading mill, thermal roll, single axis extruder, double axis extruder or homogenizer, or any other kind of shaking or dispersion device.

In this mixing and kneading step, because the various components of the thermistor element 1 are easily and frequently exposed to the surrounding atmosphere, the oxygen contaminating the thermistor element 1 can be effectively limited by adjusting the atmosphere surrounding the components so that these materials do not contact oxygen. Specific methods include for example constantly passing an inactive gas such as nitrogen, argon gas or helium gas in and/or around the device used in the mixing and kneading step so as to remove the oxygen present there, or improving the seals in and/or around the device in order to prevent inflow of oxygen and other gases from the outside.

Because the polymer matrix is particularly subject to oxidation when it is heated and kneaded at a temperature above its melting point (softening point) in the mixing and kneading step, it is preferable that the mixing and kneading step be performed with the temperature of the kneaded material below this melting point.

However, it is desirable that the polymer matrix be heated and kneaded at a temperature above its melting point for purposes of uniform mixing and kneading of the various components. Consequently, by raising the temperature of the kneaded material to a temperature above the aforementioned melting point and applying the aforementioned methods of removing oxygen from in and/or around the device, the resulting the thermistor element 1 is made to have various properties uniformly throughout the whole and a high stability of resistance.

The time required for the mixing and kneading step is normally about 5 to 90 minutes, but it is preferable to keep it as short as possible to the extent that the physical properties of the thermistor element 1 are not affected.

Next, the kneaded material (mixture) obtained in the aforementioned mixing and kneading step is sandwiched between electrode materials on both sides and crimped to prepare a sheet or film of molded product (mixture) with a thickness of about 300 to 350 μm (molding step). A metallic foil of Ni or the like can be used as the electrode material. The thickness thereof is about 25 to 35 μm. Crimping can be performed for example using a thermal press at a temperature of about 130 to 240° C.

Because in this molding step the kneaded material is heated to about 130 to 240° C. as mentioned above, the kneaded material is liable to oxidation. Consequently, it is desirable in this molding step as in the mixing and kneading step above to remove oxygen from in and/or around the device by a method such as constantly passing an inactive gas such as nitrogen, argon gas or helium gas in and/or around the device so as to remove the oxygen present there, or improving the seals in and/or around the device in order to prevent inflow of oxygen and other gases from the outside.

Moreover, because the electrode materials and the kneaded material (which will become the thermistor element 1) contact each other under pressure in this molding step, oxygen which has formed an oxide film on the surface of the electrode materials may migrate to the kneaded material due to contact under pressure during crimping. Consequently, the surface of the electrode materials which contacts the kneaded material should be covered with a film or the like up to the point of contact under pressure so as to prevent contact with oxygen.

Next, the polymer material of the molded product obtained in the aforementioned molding step is cross-linked as necessary (cross-linking step). Cross-linking methods include chemical cross-linking by means of a cross-linking reaction in which an organic peroxide is mixed into the molded product and radicals are generated by heat treatment, water cross-linking in which a condensable silane coupling agent or the like is bound to the polymer and cross-linking is accomplished by a dehydration condensation reaction in the presence of water, or radiation cross-linking in which cross-linking is accomplished using electron beams or gamma rays, but of these electron beam cross-linking is preferred. In this electron beam cross-linking the appropriate acceleration voltage and electron beam dose can be set as necessary using an electron accelerator. For example, if uniform bridging across the entire molded product is desired, electron beams with an acceleration voltage of 250 kV or more or preferably 1000 kV or more are applied at a dose of 40 to 300 KGy or preferably 40 to 200 KGy to cross-link the molded product.

In this cross-linking step, the temperature of the molded product tends to rise due to irradiation with the electron beam. Since this temperature rise is a cause of increased oxygen contamination of the molded product, it is desirable to divide a single dose into at least multiple doses in order to control the temperature rise. Moreover, from the standpoint of achieving uniform cross-linking it is desirable that the molded product be irradiated from both sides with the electron beam. It is also desirable to keep the molded product from direct contact with oxygen during irradiation.

Next, once the cross-linked molded product has been stamped or cut into a specific shape, the leads 4 and 5 are joined to the respective surfaces of the electrodes 2 and 3 as necessary to obtain the P-PTC thermistor 10 consisting of the pair of the electrodes 2 and 3 positioned facing each other, the thermistor element 1 with a positive temperature coefficient of resistance which is positioned between the electrode 2 and the electrode 3, the lead 4, which is electrically connected to the electrode 2 and the lead 5, which is electrically connected to the electrode 3. It is desirable here to keep the various parts away from direct contact with oxygen by for example passing an inactive gas or the like in and/or around the processing unit.

Contamination of the resulting the thermistor element 1 or the P-PTC thermistor 10 by adsorption, absorption or the like of oxygen should be prevented until it can be incorporated into an electronic device. Consequently, it is desirable to appropriately control contact with oxygen using a storage method or the like such as those described above.

EXAMPLES

The present invention is explained in more detail below using examples, but the present invention is not limited by these examples.

Figure 2:
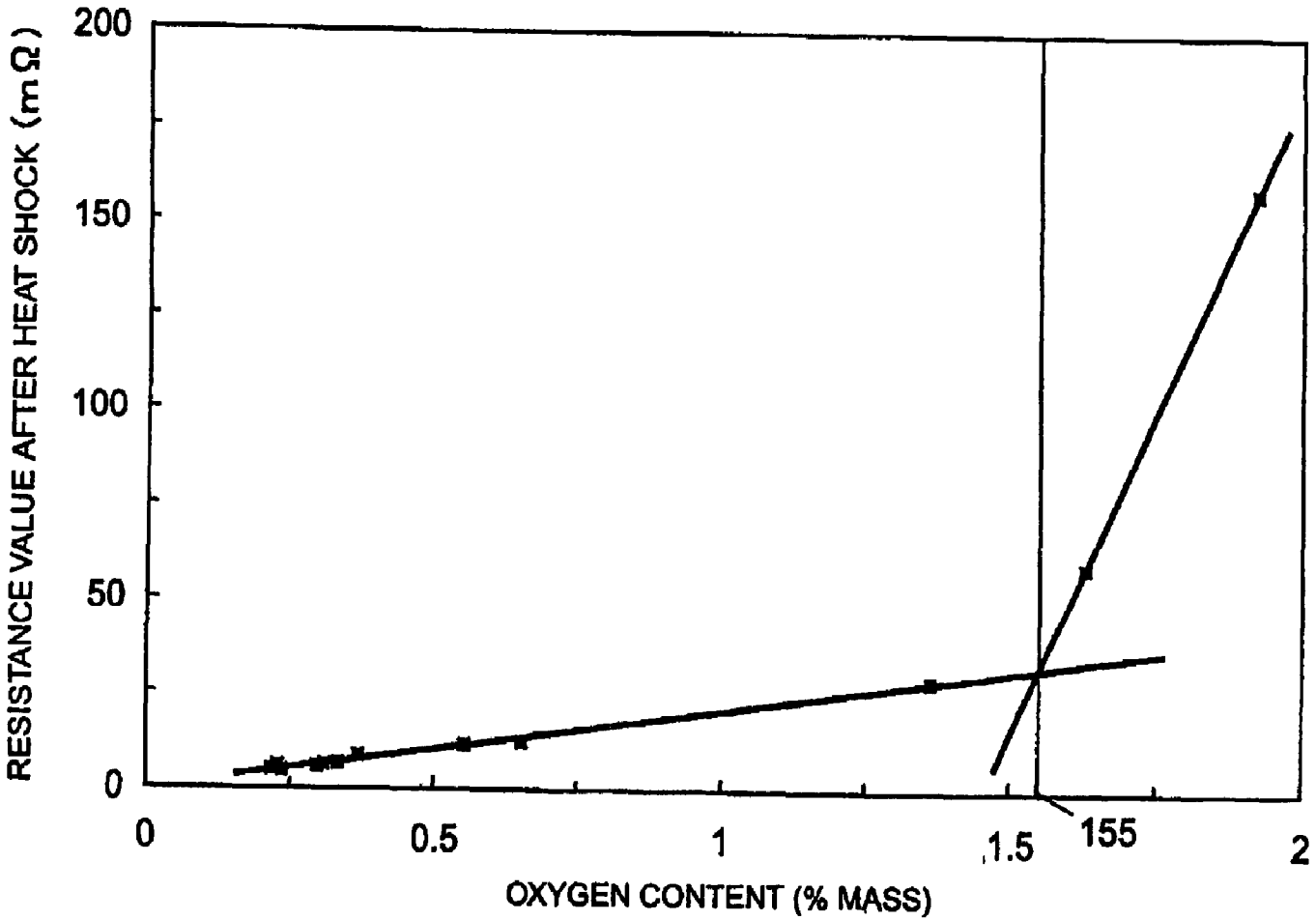
FIG. 2 is a graph showing the relationship between oxygen content and resistance after thermal shock for P-PTC thermistors of examples and comparative examples.

A graph showing the relationships between the oxygen contents of the thermistor elements provided in the P-PTC thermistors of examples 1 through 10 and comparative examples 1 and 2 below and the resistances of the thermistors after thermal shock is shown in FIG. 2.

Example 1

57% by volume of straight chain low density polyethylene manufactured using a metallocene catalyst as the polymer matrix (Evolu 2520, Mitsui Chemical, tradename), 35% by volume of filamentous particles made of nickel as the conductive particles (Type 210, INCO, trade name) and 8% by volume of polyethylene wax as the low molecular weight organic compound (PW655, Baker Petrolite, trade name) were placed in a Laboplast mill (Toyo Seiki, trade name). The mill had a chamber capacity of 60 $cm^3$, while the total volume of the materials used was 45 $cm^3$ when converted to true density.

Next, the interior of the kneading chamber of the mill was decompressed to about 6.7 kPa (about 50 Torr) using a vacuum/purge unit (Toyo Seiki), after which the chamber was sealed.

Next, heating and kneading was performed for 60 minutes at a temperature of 150° C. to obtain a kneaded product.

After completion of kneading, the resulting kneaded product was sandwiched between nickel foils (electrodes) having a thickness of 35 μm, and the kneaded product and nickel foils were crimped in a thermal press at 150° C. to obtain a molded product having overall dimensions of 6 cm×6 cm×0.35 mm. Then both sides of the molded product were irradiated with electron beams having an acceleration voltage of 2 MeV at a dose of 100 KGy in order to promote the cross-linking reaction of the polymer material inside the molded product and render it thermally and mechanically stable.

Next, it was stamped into rectangles with vertical and horizontal dimensions of 10 mm×3.6 mm. In this way, a P-PTC thermistor was obtained having a structure in which a kneaded molded sheet (thermistor element) containing a polymer matrix, conductive particles and a low molecular weight organic compound was positioned (sandwiched) tightly between two electrodes formed from nickel foil.

[Measurement of Amount of Oxygen Contained in Thermistor Element]

The amount of oxygen contained in the thermistor element obtained by peeling the electrodes from the aforementioned P-PTC thermistor was measured by the measurement method for oxygen content described above. A LECO Corporation TC-600 (trade name) was used for this measurement. The results are shown in Table 1. The oxygen content of the thermistor element provided in the aforementioned P-PTC thermistor was 0.217% by mass.

TABLE 1

| | Oxygen content (% mass) | Initial resistance (mΩ) | Resistance after thermal shock (mΩ) |
|---|---|---|---|
| Example 1 | 0.217 | 0.3 | 5.0 |
| Example 2 | 0.235 | 0.3 | 4.8 |
| Example 3 | 0.228 | 0.2 | 6.1 |
| Example 4 | 0.308 | 0.3 | 6.5 |
| Example 5 | 0.296 | 0.4 | 5.9 |
| Example 6 | 0.332 | 0.3 | 6.7 |
| Example 7 | 0.368 | 0.5 | 8.9 |
| Example 8 | 0.554 | 1.0 | 11.7 |
| Example 9 | 0.654 | 1.1 | 12.6 |
| Example 10 | 1.362 | 1.6 | 28.5 |
| Comparative example 1 | 1.629 | 1.9 | 59.2 |
| Comparative example 2 | 1.923 | 3.7 | 158.9 |

[Measurement of Resistances]

The resistance upon initial use and the resistance after thermal shock testing are standards for whether or not a P-PTC thermistor is suited for use, and these standards can be determined appropriately according to the electronic device into which the P-PTC thermistor is incorporated. For example, the compatibility standards for a P-PTC thermistor used as a battery current limiting device or over-current protection device are a resistance of 3 mΩ upon initial use and a resistance of 50 mΩ after thermal shock testing.

Such "thermal shock testing" is normally as stipulated by JIS C 0025 or MIL-STD-202F107, and this testing is accomplished by subjecting the PTC thermistor to a heat treatment cycle consisting of steps i through iv below repeated 200 times, after which the resistance (value measured at room temperature (25° C.)) is measured. That is, one heat treatment cycle consists of (i) a step of holding the PTC thermistor for 30 minutes under temperature conditions in which the temperature of the thermistor element thereof is −40° C., (ii) a step of raising the temperature of the thermistor element to 85° C. within 10% of the aforementioned holding time (3 minutes), (iii) a step of holding for 30 minutes with the temperature of the thermistor element at 85° C., and (iv) a step of lowering the temperature of the thermistor element to −40° C. within 10% of the aforementioned holding time (3 minutes).

First, the resistance of the P-PTC thermistor of Example 1 upon initial use (initial resistance) was measured at room temperature (25° C.) by the four-terminal method.

Next, a thermal shock test was performed on the P-PTC thermistor as stipulated in JIS C 0025, and the resistance after testing (resistance after thermal shock) was measured. More specifically, each P-PTC thermistor was subjected to the previously described thermal treatment cycle consisting of steps i through iv repeated 200 times, and the resistance (value measured at room temperature (25° C.)) was then measured. The results are shown in Table 1. An ESPEC TSV40ht (trade name) was used as the device for performing the thermal shock test.

Example 2

A P-PTC thermistor was prepared as in Example 1 except that instead of the kneading chamber of the mill being sealed after being decompressed to about 6.7 kPa (about 50 Torr) using a vacuum/purge unit, the kneading chamber of the mill was first decompressed to about 6.7 kPa (about 50 Torr) using a vacuum/purge unit, and then nitrogen was introduced until the pressure inside the chamber reached atmospheric pressure and the chamber was sealed. The results for oxygen content of the thermistor element and resistances are shown in Table 1.

Example 3

A P-PTC thermistor was prepared as in Example 1 except that instead of the kneading chamber of the mill being sealed after being decompressed to about 6.7 kPa (about 50 Torr) using a vacuum/purge unit, the kneading chamber of the mill was first decompressed to about 6.7 kPa (about 50 Torr) using a vacuum/purge unit, and then argon gas was introduced until the pressure inside the chamber reached atmospheric pressure and the chamber was sealed. The results for oxygen content of the thermistor element and resistances are shown in Table 1.

Example 4

A P-PTC thermistor was prepared as in Example 1 except that instead of the kneading chamber of the mill being sealed after being decompressed to about 6.7 kPa (about 50 Torr) using a vacuum/purge unit, nitrogen was steadily passed through the chamber using a purge cover without decompression (nitrogen flow 1 L/minute). The results for oxygen content of the thermistor element and resistances are shown in Table 1.

Example 5

A P-PTC thermistor was prepared as in Example 1 except that instead of the kneading chamber of the mill being sealed after being decompressed to about 6.7 kPa (about 50 Torr) using a vacuum/purge unit, argon gas was steadily passed through the chamber using a purge cover without decompression (argon flow 1 L/minute). The results for oxygen content of the thermistor element and resistances are shown in Table 1.

Example 6

A P-PTC thermistor was prepared as in Example 1 except that instead of the kneading chamber of the mill being sealed after being decompressed to about 6.7 kPa (about 50 Torr) using a vacuum/purge unit, nitrogen was steadily passed through the chamber using a purge cover without decompression (nitrogen flow 0.5 L/minute). The results for oxygen content of the thermistor element and resistances are shown in Table 1.

Example 7

A P-PTC thermistor was prepared as in Example 1 except that instead of the kneading chamber of the mill being sealed after being decompressed to about 6.7 kPa (about 50 Torr) using a vacuum/purge unit, the chamber was left in atmosphere without decompression and without being sealed. The results for oxygen content of the thermistor element and resistances are shown in Table 1.

Example 8

A P-PTC thermistor was prepared as in Example 1 except that instead of the kneading chamber of the mill being sealed after being decompressed to about 6.7 kPa (about 50 Torr) using a vacuum/purge unit, air was passed steadily through the chamber using a purge cover without decompression (air flow 0.1 L/minute). The results for oxygen content of the thermistor element and resistances are shown in Table 1.

Example 9

A P-PTC thermistor was prepared as in Example 1 except that instead of the kneading chamber of the mill being sealed after being decompressed to about 6.7 kPa (about 50 Torr) using a vacuum/purge unit, air was passed steadily through the chamber using a purge cover without decompression (air flow 0.2 L/minute). The results for oxygen content of the thermistor element and resistances are shown in Table 1.

Example 10

A P-PTC thermistor was prepared as in Example 1 except that instead of the kneading chamber of the mill being sealed after being decompressed to about 6.7 kPa (about 50 Torr) using a vacuum/purge unit, air was passed steadily through the chamber using a purge cover without decompression (air flow 0.5 L/minute). The results for oxygen content of the thermistor element and resistances are shown in Table 1.

Comparative Example 1

A P-PTC thermistor was prepared as in Example 1 except that instead of the kneading chamber of the mill being sealed after being decompressed to about 6.7 kPa (about 50 Torr) using a vacuum/purge unit, air was passed steadily through the chamber using a purge cover without decompression (air flow 1 L/minute). The results for oxygen content of the thermistor element and resistances are shown in Table 1.

Comparative Example 2

A P-PTC thermistor was prepared as in Example 1 except that instead of the kneading chamber of the mill being sealed after being decompressed to about 6.7 kPa (about 50 Torr) using a vacuum/purge unit, air was passed steadily through the chamber using a purge cover without decompression (air flow 2 L/minute). The results for oxygen content of the thermistor element and resistances are shown in Table 1.

As explained above, with the present invention it is possible to obtain a P-PTC thermistor having excellent stability of resistance such that a resistance similar to the resistance before operation is retained when the P-PTC thermistor is first operated and then returned to a non-operating state.

What is claimed is:

1. An organic positive temperature coefficient thermistor, comprising a pair of electrodes positioned facing each other and a thermistor element positioned between said pair of electrodes and having a positive temperature coefficient of resistance, wherein said thermistor element is a molded element consisting of a mixture which contains a polymer matrix and conductive particles having electronic conductivity, wherein said thermistor element has an amount of oxygen calculated by subtracting the amount of oxygen originally present in the various components of said mixture from the amount of oxygen contained in said thermistor element, which is 1.55 weight percent or less of the mass of said thermistor element, and wherein said oxygen is controlled by producing said thermistor element under an inert atmosphere.

2. The organic positive temperature coefficient thermistor according to claim 1, wherein said conductive particles are metal particles.

3. The organic positive temperature coefficient thermistor according to claim 1, wherein said conductive particles are made of nickel.

4. The organic positive temperature coefficient thermistor according to claim 1, wherein said conductive particles are filamentous.

5. The organic positive temperature coefficient thermistor according to claim 1, wherein said thermistor element further contains a low molecular weight organic compound.

6. A method for manufacturing the organic positive temperature coefficient thermistor, said thermistor comprising a pair of electrodes positioned facing each other and a thermistor element positioned between said pair of electrodes and having a positive temperature coefficient of resistance, wherein said thermistor element is a molded element consisting of a mixture which contains a polymer matrix and conductive particles having electronic conductivity, and wherein said thermistor element has an amount of oxygen calculated by subtracting the amount of oxygen originally present in the various components of said mixture from the amount of oxygen contained in said thermistor element, which is 1.55 weight percent or less of the mass of said thermistor element, said method comprising a step for manufacturing said organic positive temperature coefficient thermistor, wherein the oxygen is removed from the atmosphere to which said components of said thermistor element are exposed.

7. An organic positive temperature coefficient thermistor, comprising a pair of electrodes positioned facing each other and a thermistor element positioned between said pair of electrodes and having a positive temperature coefficient of resistance, wherein said thermistor element is a molded element consisting of a mixture which contains a polymer matrix and conductive particles having electronic conductivity, wherein said thermistor element has an amount of oxygen calculated by subtracting the amount of oxygen originally present in the various components of said mixture from the amount of oxygen contained in said thermistor element, which is 1.55 weight percent or less of the mass of said thermistor element, and wherein said calculated amount of oxygen represents oxygen that contaminates said thermistor element before and during manufacture of said thermistor element.

* * * * *